US007811425B2

(12) United States Patent
De Nora et al.

(10) Patent No.: US 7,811,425 B2
(45) **Date of Patent: *Oct. 12, 2010**

(54) NON-CARBON ANODES WITH ACTIVE COATINGS

(75) Inventors: Vittorio De Nora, Veyras (CH); Thinh T. Nguyen, Onex (CH)

(73) Assignee: Moltech Invent S.A., Luxembourg (LU)

( * ) Notice: Subject to any disclaimer, the term of this patent is extended or adjusted under 35 U.S.C. 154(b) by 545 days.

This patent is subject to a terminal disclaimer.

(21) Appl. No.: 10/591,636

(22) PCT Filed: Mar. 18, 2005

(86) PCT No.: PCT/IB2005/000759

§ 371 (c)(1),
(2), (4) Date: Sep. 5, 2006

(87) PCT Pub. No.: WO2005/090641

PCT Pub. Date: Sep. 29, 2005

(65) Prior Publication Data

US 2007/0187232 A1 Aug. 16, 2007

(30) Foreign Application Priority Data

Mar. 18, 2004 (WO) ..... PCT/IB04/00886
Apr. 29, 2004 (WO) ..... PCT/IB04/01416
May 7, 2004 (WO) ..... PCT/IB04/01024

(51) Int. Cl.
*C25C 3/06* (2006.01)
*C25C 3/12* (2006.01)
*C25C 7/02* (2006.01)

(52) U.S. Cl. ..... 204/243.1; 204/247.3; 204/280; 204/290.01; 204/290.03; 204/290.08; 205/372; 205/384; 205/385; 205/387; 205/394; 502/101

(58) Field of Classification Search ..... 204/280, 204/290.1, 290.3, 290.8, 243.1, 247.3; 205/372, 205/384, 385, 387, 394; 502/101
See application file for complete search history.

(56) References Cited

U.S. PATENT DOCUMENTS 5,248,510 A * 9/1993 Lim et al. ..... 429/236
5,954,928 A * 9/1999 Kishi et al. ..... 204/290.08
2007/0193878 A1* 8/2007 Nguyen et al. ..... 204/243.1

* cited by examiner

*Primary Examiner*—Bruce F Bell
(74) *Attorney, Agent, or Firm*—Jayadeep R Deshmukh

(57) ABSTRACT

An anode for electrowinning aluminium comprises an electrically conductive substrate that is covered with an applied electrochemically active coating comprising a layer that contains predominantly cobalt oxide CoO. The CoO layer can be connected to the substrate through an oxygen barrier layer, in particular containing copper, nickel, tungsten, molybdenum, tantalum and/or niobium.

45 Claims, No Drawings

NON-CARBON ANODES WITH ACTIVE COATINGS

FIELD OF THE INVENTION

This invention relates to a metal-based anode and other cell components for aluminium electrowinning, a method for manufacturing such an anode, a cell fitted with this anode, and a method of electrowinning aluminium in such a cell.

BACKGROUND ART

Using non-carbon anodes—i.e. anodes which are not made of carbon as such, e.g. graphite, coke, etc. . . . , but possibly contain carbon in a compound or in a marginal amount—for the electrowinning of aluminium should drastically improve the aluminium production process by reducing pollution and the cost of aluminium production. Many attempts have been made to use oxide anodes, cermet anodes and metal-based anodes for aluminium production, however they were never adopted by the aluminium industry.

For the dissolution of the raw material, usually alumina, a highly aggressive fluoride-based electrolyte at a temperature between 900° and 1000° C., such as molten cryolite, is required.

Therefore, anodes used for aluminium electrowinning should be resistant to oxidation by anodically evolved oxygen and to corrosion by the molten fluoride-based electrolyte.

The materials having the greatest resistance under such conditions are metal oxides which are all to some extent soluble in cryolite. Oxides are also poorly electrically conductive, therefore, to avoid substantial ohmic losses and high cell voltages, the use of non-conductive or poorly conductive oxides should be minimal in the manufacture of anodes. Whenever possible, a good conductive material should be utilised for the anode core, whereas the surface of the anode is preferably made of an oxide having a high electrocatalytic activity for the oxidation of oxygen ions.

Several patents disclose the use of an electrically conductive metal anode core with an oxide-based active outer part, in particular U.S. Pat. Nos. 4,956,069, 4,960,494, 5,069,771 (all Nguyen/Lazouni/Doan), 6,077,415 (Duruz/de Nora), 6,103,090 (de Nora), 6,113,758 (de Nora/Duruz) and 6,248,227 (de Nora/Duruz), 6,361,681 (de Nora/Duruz), 6,365,018 (de Nora), 6,372,099 (Duruz/de Nora), 6,379,526 (Duruz/de Nora), 6,413,406 (de Nora), 6,425,992 (de Nora), 6,436,274 (de Nora/Duruz), 6,521,116 (Duruz/de Nora/Crottaz), 6,521,115 (Duruz/de Nora/Crottaz), 6,533,909 (Duruz/de Nora), 6,562,224 (Crottaz/Duruz) as well as PCT publications WO00/40783 (de Nora/Duruz), WO01/42534 (de Nora/Duruz), WO01/42535 (Duruz/de Nora), WO01/42536 (Nguyen/Duruz/de Nora), WO02/070786 (Nguyen/de Nora), WO02/083990 (de Nora/Nguyen), WO02/083991 (Nguyen/de Nora), WO03/014420 (Nguyen/Duruz/de Nora), WO03/078695(Nguyen/de Nora), WO03/087435 (Nguyen/de Nora).

U.S. Pat. No. 4,374,050 (Ray) discloses numerous multiple oxide compositions for electrodes. Such compositions inter-alia include oxides of iron and cobalt. The oxide compositions can be used as a cladding on a metal layer of nickel, nickel-chromium, steel, copper, cobalt or molybdenum.

U.S. Pat. No. 4,142,005 (Cadwell/Hazelrigg) discloses an anode having a substrate made of titanium, tantalum, tungsten, zirconium, molybdenum, niobium, hafnium or vanadium. The substrate is coated with cobalt oxide $Co_3O_4$.

U.S. Pat. No. 6,103,090 (de Nora), U.S. Pat. No. 6,361,681 (de Nora/Duruz), U.S. Pat. No. 6,365,018 (de Nora), U.S. Pat. No. 6,379,526 (de Nora/Duruz), U.S. Pat. No. 6,413,406 (de Nora) and U.S. Pat. No. 6,425,992 (de Nora), and WO04/018731 (Nguyen/de Nora) disclose anode substrates that contain at least one of chromium, cobalt, hafnium, iron, molybdenum, nickel, copper, niobium, platinum, silicon, tantalum, titanium, tungsten, vanadium, yttrium and zirconium and that are coated with at least one ferrite of cobalt, copper, chromium, manganese, nickel and zinc. WO01/42535 (Duruz/de Nora) and WO02/097167 (Nguyen/de Nora), disclose aluminium electrowinning anodes made of surface oxidised iron alloys that contain at least one of nickel and cobalt. U.S. Pat. No. 6,638,412 (de Nora/Duruz) discloses the use of anodes made of a transition metal-containing alloy having an integral oxide layer, the alloy comprising at least one of iron, nickel and cobalt. U.S. Pat. No. 6,077,415 (Duruz/de Nora) discloses an aluminium electrowinning anode having: a metal-based core covered with an oxygen barrier layer of chromium or nickel; an intermediate layer of nickel, cobalt and/or copper on the oxygen barrier layer; and a slowly consumable electrochemically active oxide layer on this intermediate layer.

These non-carbon anodes have not as yet been commercially and industrially applied and there is still a need for a metal-based anodic material for aluminium production.

SUMMARY OF THE INVENTION

The present invention relates in particular to an anode for electrowinning aluminium from alumina dissolved in a molten electrolyte. This anode comprises an electrically conductive substrate that is covered with an applied electrochemically active coating. This coating comprises a layer that contains predominantly cobalt oxide CoO.

There are several forms of stoichiometric and non-stoichiometric cobalt oxides which are based on:

- CoO that contains Co(II) and that is formed predominantly at a temperature above 920° C. in air;
- $CO_2O_3$ that contains Co(III) and that is formed at temperatures up to 895° C. and at higher temperatures begins to decompose into CoO;
- $Co_3O_4$ that contains Co(II) and Co(III) and that is formed at temperatures between 300 and 900° C.

It has been observed that—unlike $CO_2O_3$ that is unstable and $CO_3O_4$ that does not significantly inhibit oxygen diffusion—CoO forms a well conductive electrochemically active material for the oxidation of oxygen ions and for inhibiting diffusion of oxygen. Thus this material forms a limited barrier against oxidation of the metallic cobalt body underneath.

The anode's CoO-containing layer can be a layer made of sintered particles, especially sintered CoO particles. Alternatively, the CoO-containing layer may be an integral oxide layer on an applied Co-containing metallic layer of the coating. Tests have shown that integral oxide layers have a higher density than sintered layers and are thus preferred to inhibit oxygen diffusion.

When CoO is to be formed by oxidising metallic cobalt, care should be taken to carry out a treatment that will indeed result in the formation of CoO. It was found that using $Co_2O_3$ or $Co_3O_4$ in a known aluminium electrowinning electrolyte does not lead to an appropriate conversion of these forms of cobalt oxide into CoO. Therefore, it is important to provide an anode with the CoO layer before the anode is used in an aluminium electrowinning electrolyte.

The formation of CoO on the metallic cobalt is preferably controlled so as to produce a coherent and substantially crack-free oxide layer. However, not any treatment of metallic cobalt at a temperature above 895° C. or 900° C. in an oxygen-containing atmosphere will result in the formation of an optimal coherent and substantially crack-free CoO layer that offers better electrochemical properties than a $Co_2O_3$/$Co_3O_4$.

For instance, if the temperature for treating the metallic cobalt to form CoO by air oxidation of metallic cobalt is increased at an insufficient rate, e.g. less than 200° C./hour, a thick oxide layer rich in $Co_3O_4$ and in glassy $Co_2O_3$ is formed at the surface of the metallic cobalt. Such a layer does not permit optimal formation of the CoO layer by conversion at a temperature above 895° C. of $Co_2O_3$ and $Co_3O_4$ into CoO. In fact, a layer of CoO resulting from such conversion has an increased porosity and may be cracked. Therefore, the required temperature for air oxidation, i.e. above 900° C., usually at least 920° C. or preferably above 940° C., should be attained sufficiently quickly, e.g. at a rate of increase of the temperature of at least 300° C. or 600° C. per hour to obtain an optimal CoO layer. The metallic cobalt may also be placed into an oven that is pre-heated at the desired temperature above 900° C.

Likewise, if the anode is not immediately used for the electrowinning of aluminium after formation of the CoO layer but allowed to cool down, the cooling down should be carried out sufficiently fast, for example by placing the anode in air at room temperature, to avoid significant formation of $Co_3O_4$ that could occur during the cooling, for instance in an oven that is switched off.

An anode with a CoO layer obtained by slow heating of the metallic cobalt in an oxidising environment will not have optimal properties but still provides better results during cell operation than an anode having a $Co_2O_3$—$Co_3O_4$ layer and therefore also constitutes an improved aluminium electrowinning anode according to the invention.

The Co-containing metallic layer can contain alloying metals for further reducing oxygen diffusion and/or corrosion through the metallic layer.

In one embodiment, the anode comprises an oxygen barrier layer between the CoO-containing layer and the electrically conductive substrate. The oxygen barrier layer can contain at least one metal selected from nickel, copper, tungsten, molybdenum, tantalum, niobium and chromium, or an oxide thereof, for example alloyed with cobalt, such as a cobalt alloy containing tungsten, molybdenum, tantalum and/or niobium, in particular an alloy containing: at least one of nickel, tungsten, molybdenum, tantalum and niobium in a total amount of 5 to 30 wt %, such as 10 to 20 wt %; and one or more further elements and compounds in a total amount of up to 5 wt % such as 0.01 to 4 weight %, the balance being cobalt. These further elements may contain at least one of aluminium, silicon and manganese.

Typically, the oxygen barrier layer and the CoO-containing layer are formed by oxidising the surface of an applied layer of the abovementioned cobalt alloy that contains nickel, tungsten, molybdenum, tantalum and/or niobium. The resulting CoO-containing layer is predominantly made of CoO and is integral with the unoxidised part of the metallic cobalt alloy that forms the oxygen barrier layer.

When the CoO layer is integral with the cobalt alloy, the nickel, when present, should be contained in the alloy in an amount of up to 20 weight %, in particular 5 to 15 weight %. Such an amount of nickel in the alloy leads to the formation of a small amount of nickel oxide NiO in the integral oxide layer, in about the same proportions to cobalt as in the metallic part, i.e. 5 to 15 or 20 weight %. It has been observed that the presence of a small amount of nickel oxide stabilises the cobalt oxide CoO and durably inhibits the formation of $Co_2O_3$ or $Co_3O_4$. However, when the weight ratio nickel/cobalt exceeds 0.15 or 0.2, the advantageous chemical and electrochemical properties of cobalt oxide CoO tend to disappear. Therefore, the nickel content should not exceed this limit.

Alternatively, an oxygen barrier layer, for example made of the above cobalt alloy that contains nickel, tungsten, molybdenum, tantalum and/or niobium, can be covered with an applied layer of CoO or a precursor thereof, as discussed above. In this case the oxygen barrier layer can be an applied layer or it can be integral with the electrically conductive substrate.

In another embodiment, the Co-containing metallic layer consists essentially of cobalt, typically containing cobalt in an amount of at least 95 wt %, in particular more than 97 wt % or 99 wt %.

Optionally the Co-containing metallic layer contains at least one additive selected from silicon, manganese, niobium, tantalum and aluminium in a total amount of 0.1 to 2 wt %.

Such a Co-containing layer can be applied to an oxygen barrier layer which is integral with the electrically conductive substrate or applied thereto.

The electrically conductive substrate can comprise at least one metal selected from chromium, cobalt, hafnium, iron, molybdenum, nickel, copper, platinum, silicon, titanium, tungsten, molybdenum, tantalum, niobium, vanadium, yttrium and zirconium, or a compound thereof, in particular an oxide, or a combination thereof. For instance, the electrically conductive substrate may have an outer part made of cobalt or an alloy containing predominantly cobalt to which the coating is applied. For instance, this cobalt alloy contains nickel, tungsten, molybdenum, tantalum and/or niobium, in particular it contains: nickel, tungsten, molybdenum, tantalum and/or niobium in a total amount of 5 to 30 wt %, e.g. 10 to 20 wt %; and one or more further elements and compounds in a total amount of up to 5 wt %, the balance being cobalt. These further elements may contain at least one of aluminium, silicon and manganese. The electrically conductive substrate may contain at least one oxidation-resistant metal, in particular one or more metals selected from nickel, tungsten, molybdenum, cobalt, chromium and niobium. The electrically conductive substrate, or an outer part thereof, can consist essentially of at least one oxidation-resistant metal and for example contain less than 1, 5 or 10 wt % in total of other metals and metal compounds, in particular oxides.

Advantageously, the anode's integral oxide layer has an open porosity of below 12%, in particular below 7%.

The anode's integral oxide layer can have a porosity with an average pore size below 7 micron, in particular below 4 micron. It is preferred to provide a substantially crack-free integral oxide layer so as to protect efficiently the anode's metallic outer part which is covered by this integral oxide layer.

Usually, the CoO-containing layer contains cobalt oxide CoO in an amount of at least 80 wt %, in particular more than 90 wt % or 95 wt % or 98 wt %.

Advantageously, the CoO-containing layer is substantially free of cobalt oxide $Co_2O_3$ and substantially free of $Co_3O_4$, and contains preferably below 3 or 1.5% of these forms of cobalt oxide.

The CoO-containing layer may be electrochemically active for the oxidation of oxygen ions during use, in which case this layer is uncovered or is covered with an electrolyte-pervious layer.

Alternatively, the CoO-containing layer can be covered with an applied protective layer, in particular an applied oxide layer such as a layer containing cobalt and/or iron oxide, e.g. cobalt ferrite. The applied protective layer may contain a pre-formed and/or in-situ deposited cerium compound, in particular cerium oxyfluoride, as for example disclosed in the abovementioned U.S. Pat. Nos. 4,956,069, 4,960,494 and 5,069,771. Such an applied protective layer is usually electrochemically active for the oxidation of oxygen ions and is uncovered, or covered in turn with an electrolyte pervious-layer.

The anode's electrochemically active surface can contain at least one dopant, in particular at least one dopant selected from iridium, palladium, platinum, rhodium, ruthenium, silicon, tungsten, molybdenum, tantalum, niobium, tin or zinc metals, Mischmetal and metals of the Lanthanide series, as metals and compounds, in particular oxides, and mixtures thereof. The dopant(s) can be present at the anode's surface in a total amount of 0.1 to 5 wt %, in particular 1 to 4 wt %.

Such a dopant can be an electrocatalyst for fostering the oxidation of oxygen ions on the anode's electrochemically active surface and/or can contribute to inhibit diffusion of oxygen ions into the anode.

The dopant may be added to the precursor material that is applied to form the active surface or it can be applied to the active surface as a thin film, for example by plasma spraying or slurry application, and incorporated into the surface by heat treatment.

The invention also relates to a method of manufacturing an anode as described above, comprising: providing an electrically conductive anode substrate; and forming an electrochemically active coating on the substrate by applying one or more layers onto the substrate, one of which contains predominantly cobalt oxide CoO.

The CoO-containing layer can be formed by applying a layer of particulate CoO to the anode and sintering. For instance, the CoO-containing layer is applied as a slurry, in particular a colloidal and/or polymeric slurry, and then heat treated. Good results have been obtained by slurring particulate metallic cobalt or CoO, optionally with additives such as Ta, in an aqueous solution containing at least one of ethylene glycol, hexanol, polyvinyl alcohol, polyvinyl acetate, polyacrylic acid, hydroxy propyl methyl cellulose and ammonium polymethacrylate and mixtures thereof, followed by application to the anode, e.g. painting or dipping, and heat treating.

The CoO-containing layer can be formed by applying a Co-containing metallic layer to the anode and subjecting the metallic layer to an oxidation treatment to form the CoO-containing layer on the metallic layer, the CoO-containing layer being integral with the metallic layer.

Conveniently, the oxidation treatment can be carried out in an oxygen containing atmosphere, such as air. The treatment can also be carried out in an atmosphere that is oxygen rich or consists essentially of pure oxygen.

It is also contemplated to carry out this oxidation treatment by other means, for instance electrolytically. However, it was found that full formation of the CoO integral layer cannot be achieved in-situ during aluminium electrowinning under normal cell operating conditions. In other words, when the anode is intended for use in a non-carbon anode aluminium electrowinning cell operating under the usual conditions, the anode should always be placed into the cell with a preformed integral oxide layer containing predominantly CoO.

As the conversion of Co(III) into Co(II) occurs at a temperature of about 895° C., the oxidation treatment should be carried out above this temperature. Usually, the oxidation treatment is carried out at a treatment temperature above 895° C. or 920° C., preferably above 940° C., in particular within the range of 950° C. to 1050° C. The Co-containing metallic layer can be heated from room temperature to this treatment temperature at a rate of at least 300° C./hour, in particular at least 450° C./hour, or is placed in an environment, in particular in an oven, that is preheated to said temperature. The oxidation treatment at this treatment temperature can be carried out for more than 8 or 12 hours, in particular from 16 to 48 hours. Especially when the oxygen-content of the oxidising atmosphere is increased, the duration of the treatment can be reduced below 8 hours, for example down to 4 hours.

The Co-containing metallic layer can be further oxidised during use. However, the main formation of CoO is preferably achieved before use and in a controlled manner for the reasons explained above.

A further aspect of the invention relates to a cell for the electrowinning of aluminium from alumina dissolved in a molten electrolyte, in particular a fluoride-containing electrolyte. This cell comprises an anode as described above.

The anode may be in contact with the cell's molten electrolyte which is at a temperature below 950° C. or 960° C., in particular in the range from 910° to 940° C.

Another aspect of the invention relates to a method of electrowinning aluminium in a cell as described above. The method comprises passing an electrolysis current via the anode through the electrolyte to produce oxygen on the anode and aluminium cathodically by electrolysing the dissolved alumina contained in the electrolyte.

Oxygen ions may be oxidised on the anode's CoO-containing layer that contains predominantly cobalt oxide CoO and/or, when present, on an active layer applied to the anode's CoO layer, the CoO layer inhibiting oxidation and/or corrosion of the anode's metallic outer part.

Yet in another aspect of the invention, the coated substrate as described above can be used to make other cell components, in particular anode stems for suspending the anodes, cell sidewalls or cell covers. The coating's CoO is particularly useful to protect oxidation or corrosion resistant surfaces. This coated substrate can incorporate any of the feature disclosed above or combination of such features The invention will be further described in the following examples:

EXAMPLE 1

An anode according to the invention was made by covering a metallic cobalt substrate with an applied electrochemically active coating comprising an outer CoO layer and an inner layer of tantalum and cobalt oxides.

The coating was formed by applying cobalt and tantalum using electrodeposition. Specifically, tantalum was dispersed in the form of physical inclusions in cobalt electrodeposits.

The electrodeposition bath had a pH of 3.0 to 3.5 and contained:

400 g/l $CoSO_4.7H_2O$;
40 g/l $H_3BO_3$;
40 g/l KCl; and
7-10 g/l Ta particles.

The tantalum particles had a size below 10 micron and were dispersed in the electrodeposition bath.

Electrodeposition on the cobalt substrate was carried out at a current density of 35 mA/cm$^2$ which led to a cobalt deposit containing Ta inclusions, the deposit growing at a rate of 45 micron per hour on the substrate.

After the deposit had reached a total thickness of 250-300 micron, electrodeposition was interrupted. The deposit contained 9-15 wt % Ta corresponding to a volume fraction of 4-7 v %.

To form a coating according to the invention, the substrate with its deposit were exposed to an oxidation treatment at a temperature of 950° C. The substrate with its deposit were brought from room temperature to 950° C. at a rate of 450-500° C./hour in an oven to optimise the formation of CoO instead of $Co_2O_3$ or $Co_3O_4$.

After 8 hours at 950° C., the substrate and the coating that was formed by oxidation of the deposit were taken out of the oven and allowed to cool down to room temperature. The coating had an outer oxide layer CoO on an inner oxide layer of Co—Ta oxides, in particular $CoTaO_4$, that had grown from the deposit. The innermost part of the deposit had remained unoxidised, so that the Co—Ta oxide layer was integral with the remaining metallic Co—Ta deposit. The Co—Ta oxide layer and the CoO layer had a total thickness of about 200 micron on the remaining metallic Co—Ta.

As demonstrated in Example 2, this CoO outer layer can act as an electrochemically active anode surface. The inner Co—Ta oxide layer inhibits oxygen diffusion towards the metallic cobalt substrate.

EXAMPLE 2

An anode was made of a cobalt substrate covered with a Co—Ta coating as in Example 1 and used in a cell for the electrowinning aluminium according to the invention.

The anode was suspended in the cell's electrolyte at a distance of 4 cm from a facing cathode. The electrolyte contained 11 wt % $AlF_3$, 4 wt % $CaF_2$, 7 wt % KF and 9.6 wt % $Al_2O_3$, the balance being $Na_3AlF_6$. The electrolyte was at a temperature of 925° C.

An electrolysis current was passed from the anode to the cathode at an anodic current density of 0.8 A/cm$^2$. The cell voltage remained remarkably stable at 3.6 V throughout electrolysis.

After 150 hours electrolysis, the anode was removed from the cell. No significant change of the anode's dimensions was observed by visual examination.

EXAMPLE 3

Example 1 was repeated by applying a Co—Ta coating onto an anode substrate made of a metallic alloy containing 75 wt % Ni, 15 wt % Fe and 10 wt % Cu.

The anode was tested as in Example 2 at an anodic current density of 0.8 A/cm$^2$. At start-up, the cell voltage was at 4.2 V and decreased within the first 24 hours to 3.7 V and remained stable thereafter.

After 120 hours electrolysis, the anode was removed from the cell. No sign of passivation of the nickel-rich substrate was observed and no significant change of dimensions of the anode was noticed by visual examination of the anode.

EXAMPLE 4

Examples 1 to 3 can be repeated by substituting tantalum with niobium.

EXAMPLE 5

Another anode according to the invention was made by applying a coating of Co—W onto an anode substrate made of a metallic alloy containing 75 wt % Ni, 15 wt % Fe and 10 wt % Cu.

The coating was formed by applying cobalt and tungsten using electrodeposition. The electrodeposition bath contained:

100 g/l $CoCl_2.6H_2$);
45 g/l $Na_2WO_4.2H_2O$;
400 g/l $KNaC_4H_4O_6.4H_2O$; and
50 g/l $NH_4Cl$.

Moreover, $NH_4OH$ had been added to this bath so that the bath had reached a pH of 8.5-8.7.

Electrodeposition on the Ni—Fe—Cu substrate was carried out at a temperature of 82-90° C. and at a current density of 50 mA/cm$^2$ which led to a cobalt-tungsten alloy deposit on the substrate, the deposit growing at a rate of 35-40 micron per hour at a cathodic current efficiency of about 90%.

After the deposit had reached a total thickness of about 250 micron, electrodeposition was interrupted. The deposited cobalt alloy contained 20-25 wt % tungsten.

To form a coating according to the invention, the substrate with its deposit were exposed to an oxidation treatment at a temperature of 950° C. The substrate with its deposit were brought from room temperature to 950° C. at a rate of 450-500° C./hour in an oven to optimise the formation of CoO instead of $Co_2O_3$ or $Co_3O_4$.

After 8 hours at 950° C., the substrate and the coating that was formed by oxidation of the deposit were taken out of the oven and allowed to cool down to room temperature. The coating contained at its surface cobalt monoxide and tungsten oxide.

The structure of the coating after oxidation was denser and more coherent than the coating obtained by oxidising an electrodeposited layer of Ta—Co as disclosed in Example 1.

As demonstrated in Example 6, this coating can act as an electrochemically active anode surface. The presence of tungsten inhibits oxygen diffusion towards the metallic cobalt substrate.

EXAMPLE 6

An anode was made as in Example 5 and used in a cell for the electrowinning aluminium according to the invention.

The anode was suspended in the cell's electrolyte at a distance of 4 cm from a facing cathode. The electrolyte contained 11 wt % $AlF_3$, 4 wt % $CaF_2$, 7 wt % KF and 9.6 wt % $Al_2O_3$, the balance being $Na_3AlF_6$. The electrolyte was at a temperature of 925° C.

An electrolysis current was passed from the anode to the cathode at an anodic current density of 0.8 A/cm$^2$. The cell voltage remained stable at 3.5-3.7 V throughout electrolysis.

After 100 hours electrolysis, the anode was removed from the cell. No change of the anode's dimensions was observed by visual examination.

EXAMPLE 7

Examples 5 and 6 can be repeated with an anode substrate made of cobalt, nickel or an alloy of 92 wt % nickel and 8 wt % copper.

The invention claimed is:

1. In a cell for electrowinning aluminium, the cell containing a molten electrolyte in which alumina is dissolved, an anode that is in contact with the molten electrolyte for electrowinning aluminium from the alumina dissolved in the molten electrolyte, said anode comprising an electrically conductive substrate that is covered with an applied electrochemically active coating, said coating comprising a layer that contains predominantly cobalt oxide CoO.

2. The anode of claim 1, wherein the CoO-containing layer is a layer of sintered particles.

3. The anode of claim 1, wherein the CoO-containing layer is an integral oxide layer on an applied Co-containing metallic layer of the coating.

4. The anode of claim 3, wherein the Co-containing metallic layer contains cobalt in an amount of at least 95 wt %, in particular more than 97 wt % or 99 wt %.

5. The anode of claim 3, wherein the Co-containing metallic layer contains at least one additive selected from silicon, manganese, nickel, niobium, tantalum and aluminium in a total amount of 0.1 to 2 wt %.

6. The anode of claim 1, which comprises an oxygen barrier layer between the CoO-containing layer and the electrically conductive substrate.

7. The anode of claim 6, wherein the oxygen barrier layer contains at least one metal selected from nickel, copper, tungsten, molybdenum, tantalum, niobium and chromium, or an oxide thereof.

8. The anode of claim 7, wherein the oxygen barrier layer further contains cobalt.

9. The anode of claim 8, wherein the oxygen barrier layer is a cobalt alloy containing at least one metal selected from nickel, tungsten, molybdenum, tantalum and niobium.

10. The anode of claim 9, wherein the cobalt alloy contains:

at least one of nickel, tungsten, molybdenum, tantalum and niobium in a total amount of 5 to 30 wt %, in particular 10-20 wt %; and one or more further elements and compounds in a total amount of up to 5 wt %, the balance being cobalt.

11. The anode of claim 10, containing as said further elements at least one of aluminium, silicon and manganese.

12. The anode of claim 6, wherein the CoO-containing layer is integral with the oxygen barrier layer.

13. The anode of claim 6, wherein the oxygen barrier layer is integral with the electrically conductive substrate.

14. The anode of claim 6, wherein the oxygen barrier layer and the CoO-containing layer, or precursors thereof, are distinct applied layers.

15. The anode of claim 1, wherein the electrically conductive substrate comprises at least one metal selected from chromium, cobalt, hafnium, iron, nickel, copper, platinum, silicon, tungsten, molybdenum, tantalum, niobium, titanium, tungsten, vanadium, yttrium and zirconium, or a compound thereof, in particular an oxide, or a combination thereof.

16. The anode of claim 15, wherein the electrically conductive substrate has an outer part made of cobalt or a cobalt-rich alloy to which the coating is applied.

17. The anode of claim 16, wherein the outer part is made of a cobalt-rich alloy containing at least one of tungsten, molybdenum, tantalum and niobium, said cobalt alloy containing:

at least one of nickel, tungsten, molybdenum, tantalum and niobium in a total amount of 5 to 30 wt %, in particular 10-20 wt; and one or more further elements and compounds in a total amount of up to 5 wt %, the balance being cobalt.

18. The anode of claim 1, wherein the electrically conductive substrate contains at least one oxidation-resistant metal, in particular a metal selected from nickel, cobalt, chromium and niobium.

19. The anode of claim 18, wherein the electrically conductive substrate consists essentially of at least one oxidation-resistant metal.

20. The anode of claim 1, wherein the CoO-containing layer has an open porosity of up to 12%, in particular up to 7%.

21. The anode of claim 1, wherein the CoO-containing layer has a porosity with an average pore size below 7 micron, in particular below 4 micron.

22. The anode of claim 1, wherein the CoO-containing layer contains cobalt oxide CoO in an amount of at least 80 wt %, in particular more than 90 wt % or 95 wt %.

23. The anode of claim 1, wherein the CoO-containing layer is substantially free of $Co_2O_3$ and substantially free of $Co_3O_4$.

24. The anode of claim 1, wherein the CoO-containing layer is electrochemically active for the oxidation of oxygen ions and is uncovered or is covered with an electrolyte-pervious layer.

25. The anode of claim 1, wherein the CoO-containing layer is covered with an applied protective layer, in particular an applied oxide layer.

26. The anode of claim 25, wherein the applied protective layer contains cobalt oxide.

27. The anode of claim 25, wherein the applied protective layer contains iron oxide.

28. The anode of claim 27, wherein the applied protective layer contains oxides of cobalt and of iron, in particular cobalt ferrite.

29. The anode of claim 25, wherein the applied protective layer contains a cerium compound, in particular cerium oxyfluoride.

30. The anode of claim 25, wherein the applied protective layer is electrochemically active for the oxidation of oxygen ions and is uncovered or is covered with an electrolyte pervious-layer.

31. The anode of claim 1, which has an electrochemically active surface that contains at least one dopant selected from iridium, palladium, platinum, rhodium, ruthenium, silicon, tungsten, molybdenum, tantalum, niobium, tin or zinc metals, Mischmetal, metals of the Lanthanide series, as metals and compounds, in particular oxides, and mixtures thereof.

32. The anode of claim 31, wherein the electrochemically active surface is made of an active material containing the dopant(s) in a total amount of 0.1 to 5 wt %, in particular 1 to 4 wt %.

33. A method of manufacturing an anode as defined in claim 1 comprising:

providing an electrically conductive anode substrate;

forming an electrochemically active coating on the substrate by applying one or more layers onto the substrate, one of which contains predominantly cobalt oxide CoO; and contacting the anode with the molten electrolyte.

34. The method of claim 33, wherein the CoO-containing layer is formed by applying a layer of particulate CoO to the anode and sintering.

35. The method of claim 34, wherein the CoO-containing layer is applied as a slurry, in particular a colloidal and/or polymeric slurry, and then heat treated.

36. The method of claim 35, wherein the Co-containing metallic layer is further oxidised during use.

37. The method of claim 33, wherein the CoO-containing layer is formed by applying a Co-containing metallic layer to the anode and subjecting the applied metallic layer to an oxidation treatment to form said CoO-containing layer on said metallic layer, said CoO-containing layer being integral with said metallic layer.

38. The method of claim 37, wherein the oxidation treatment is carried out in an oxygen containing atmosphere, such as air.

39. The method of claim 38, wherein the oxidation treatment at said treatment temperature is carried out for more than 8 or 12 hours, in particular from 16 to 48 hours.

40. The method of claim 37, wherein the oxidation treatment is carried out at a treatment temperature above 895° C. or 920° C., preferably above 940° C., in particular within the range 950° C. to 1050° C.

41. The method of claim 40, wherein the Co-containing metallic layer is heated from room temperature to said treatment temperature at a rate of at least 300° C./hour, in particular at least 450° C./hour, for example by being placed in an environment, in particular in an oven, that is preheated to said treatment temperature.

42. The anode of claim 1, in said cell wherein the electrolyte is being at a temperature below 960° C., in particular in the range from 910° to 940° C.

43. A method of electrowinning aluminium using an anode in a cell as defined in claim 1, said method comprising passing an electrolysis current via the anode through the electrolyte to produce oxygen on the anode and aluminium cathodically by electrolysing the dissolved alumina contained in the electrolyte.

44. The method of claim 43, wherein oxygen ions are oxidised on the anode's CoO-containing layer.

45. The method of claim 43, wherein oxygen ions are oxidised on an active layer applied to the anode's CoO-containing layer that inhibits oxidation and/or corrosion of the anode's substrate.

* * * * *